US007200976B2

(12) United States Patent
Gösslinghoff

(10) Patent No.: US 7,200,976 B2
(45) Date of Patent: Apr. 10, 2007

(54) METHOD AND DEVICE FOR FORMING HORIZONTAL STACKS OF PRINTED PRODUCTS AND SECURING SAID STACKS WITH STRAPS

(75) Inventor: Reinhard Gösslinghoff, Wetzikon (CH)

(73) Assignee: Ferag AG, Hinwil (CH)

( * ) Notice: Subject to any disclaimer, the term of this patent is extended or adjusted under 35 U.S.C. 154(b) by 269 days.

(21) Appl. No.: 10/521,489

(22) PCT Filed: Jun. 11, 2003

(86) PCT No.: PCT/CH03/00370

§ 371 (c)(1),
(2), (4) Date: Jan. 18, 2005

(87) PCT Pub. No.: WO2004/009448

PCT Pub. Date: Jan. 29, 2004

(65) Prior Publication Data

US 2005/0206063 A1 Sep. 22, 2005

(30) Foreign Application Priority Data

Jul. 19, 2002 (CH) ..... 1271/02

(51) Int. Cl.
*B65B 13/02* (2006.01)
*B65B 35/30* (2006.01)

(52) U.S. Cl. ..... 53/399; 53/528; 53/542

(58) Field of Classification Search ..... 53/399, 53/157, 523, 528, 529, 542, 588, 589, 590, 53/591; 100/25, 26
See application file for complete search history.

(56) References Cited

U.S. PATENT DOCUMENTS 3,266,412 A * 8/1966 Rodenbusch ..... 53/582

(Continued)

FOREIGN PATENT DOCUMENTS

EP 0 623 542 A1 5/1994
FR 2 777 876 A1 4/1998

OTHER PUBLICATIONS

Patent Abstracts of Japan, Publication No.: 2000118511, Publication Date: Apr. 25, 2000, Title: Printing Sheet Binder.

(Continued)

*Primary Examiner*—Louis Huynh
(74) *Attorney, Agent, or Firm*—Rankin, Hill, Porter & Clark LLP

(57) ABSTRACT

Recumbent stacks of printed products are produced and strapped by supplying the printed products from above onto a conveying surface (2) where they are lined up in an upright position forming a continuously growing stack (6), separating discreet stacks (7) from the growing stack, stabilizing the discreet stacks with endplates (4), and conveying the stabilized stacks to a strapping position (12), in which a loop of strapping material is tightened around the stack (7). For conveying and strapping, the isolated stack (7) is gripped between two compression jaws (10, 11) that extend into the stack area (16) from a first side. In the strapping position (12), a strapping device (30) is situated on the side opposite the stack area (16). For strapping, at least part of the strapping device is moved horizontally in relation to the stack, and transverse to the stacking direction (S), thereby placing a loop of the strapping material around the stack. The loop is then tightened and closed around the stack and the compression jaws (10, 11) and the strapped stack is separated from the compression jaws by moving the stack (7) and the compression jaws (10, 11) relative to each other, horizontally and transverse to the stacking direction.

18 Claims, 7 Drawing Sheets

U.S. PATENT DOCUMENTS 3,648,431 A * 3/1972 Hartbauer et al. ..... 53/528
4,292,785 A 10/1981 Hammond
4,531,343 A * 7/1985 Wood ..... 53/542
4,611,705 A * 9/1986 Fluck ..... 53/542
4,765,451 A * 8/1988 Labombarde ..... 53/542
4,772,003 A * 9/1988 Nobuta et al. ..... 270/52.14
4,879,862 A * 11/1989 Nolte et al. ..... 53/542
5,515,667 A 5/1996 Roosli
6,782,678 B1 * 8/2004 Bodereau ..... 53/542
7,021,035 B2 * 4/2006 Muri et al. ..... 53/542

OTHER PUBLICATIONS

Patent Abstracts of Japan, Publication No.: 08113210, Publication Date: May 7, 1996, Title: Binding Machine.

* cited by examiner

METHOD AND DEVICE FOR FORMING HORIZONTAL STACKS OF PRINTED PRODUCTS AND SECURING SAID STACKS WITH STRAPS

BACKGROUND OF THE INVENTION

1. Field of the Invention

The invention is situated in the area of the further processing of printed products and concerns a method and device in accordance with the generic parts of the corresponding, independent claims. Method and device serve the production and strapping of recumbent stacks of printed products.

2. Description of the Related Art

In the printing industry, intermediate and part products, such as individual sections of newspapers and periodicals being printed prior to other sections, signatures to be made into books, or single sheets, prospectuses, small brochures, part sheets, etc. to be inserted into newspapers or periodicals as supplements or as collated parts, require intermediate storage between production and further processing and therefore must be transported within the company or, if necessary, from one company to another. For such intermediate storage and transportation it has long proven advantageous to arrange the intermediate products in recumbent stacks, so called bars, and e.g. to store and transport these, stacked on pallets.

Usually the length (perpendicular to the flat surface of the printed products) of these aforementioned stacks is substantially greater than the length of the edges of the printed products. This means that such stacks are unstable without aid, even in an upright position. The length of the stacks corresponds e.g. with the measurements of the pallets on which they are stacked to be stored and transported, i.e. the stacks normally measure 120 or 150 cm in length and may contain e.g. 200 to 300 printed products. The stacks are laid on to the pallets and stacked on top of each other, forming storage units which are easily and compactly handled with commonly used warehouse vehicles.

The ends of the stacks are usually stabilized by endplates, e.g. wooden plates which correspond in size to the stacked products, and the stacks are held together in a compressed condition by a strap, e.g. consisting of a plastic tape. The strap runs across the longer edge of rectangular products; depending on the format of the product, once in the middle, or twice dividing the stack face into three about equal parts.

The recumbent stacks are usually produced by lining up products standing on one edge, by stabilizing the lined-up products at either end with endplates, and by subsequent compression and strapping. The printed products to be processed into such stacks are therefore e.g. supplied in a stream of printed products overlapping each other (imbricated stream) from above on to a horizontal, or slightly sloping, conveying surface and are positioned thereon. Standing one behind the other on one edge (usually folding edge or back edge) and supporting each other on the conveying surface, they are conveyed or pushed away from the supply point. Thus a recumbent stack is formed on the conveying surface which stack grows continuously in the stacking direction (conveying direction of the conveying surface). From this continuously growing stack, discreet stacks of a pre-determined length or number of products are successively isolated, fitted with endplates on both ends, compressed and strapped. The endplates are usually positioned during stack growth in corresponding gaps of the growing stack. In order to be strapped, the isolated stacks, fitted with endplates, are accelerated in stacking direction and conveyed into a strapping position. After strapping the stacks are conveyed away.

A device for the formation and strapping of recumbent stacks of printed products, as described briefly above, is e.g. known from the publication U.S. Pat. No. 4,772,003 (Nobuta et al.). In this device an imbricated stream is supplied from above on to a slightly sloping conveying surface. The supply is periodically interrupted such that discreet stacks are produced straight away. In order to support the stacks being formed on the conveying surface, to position the endplates, and to forward the complete stack in the stacking direction, intermittently activated elements are used; three of which reaching into the area of the stack from below the conveying surface and one from above. To be compressed and strapped, the forwarded complete stack is pushed transverse to the stacking direction into a compression and strapping station, its faces being supported by stationary supports.

A further device for producing and strapping recumbent stacks of printed products is known from the publication EP-0623542 (Grapha-Holding AG). In this device an imbricated stream is continuously supplied on to the conveying surface, creating a continuously growing stack. To intercept the continuously growing stack a four-part dividing element is inserted into the stack at the supply point, is conveyed with the growing stack in the stacking direction, and is then straddled to create a gap. Halves of a downstream and an upstream compression jaw, which also position the endplates, are inserted into the gap from either side of the stack. The compression jaws take over the stack from the components of the four-part dividing element and forward it in stacking direction to be compressed and strapped. The compression jaws are arranged on a guide system above the conveying surface, which enables them to move back and forth parallel to the stacking direction. In addition, the halves of the compression jaws can be moved transverse to the stacking direction in and out of the stack area. A stationary looping channel is provided in the strapping position. For strapping, strapping material positioned in the looping channel is extracted to be placed around the stack and is then tightened. The looping channel comprises two vertical components, one on the entry side and one on the exit side of the strapping position, and a horizontal component which connects the vertical components by reaching lengthwise across a stack to be strapped. The horizontal channel component is arranged in such a way that it lies between the two halves of the compression jaws which convey the stack into the strapping position. For this conveyance the entry side vertical channel component is lowered below the conveying surface. This means that the loop of the strapping material cannot be placed in the looping channel until the stack is positioned in the strapping position and the vertical channel component has been repositioned in its active position above the conveying surface.

SUMMARY OF THE INVENTION

The invention includes a method and a device for producing and strapping recumbent stacks, wherein the method and device according to the invention are to be simpler and more flexible than corresponding methods and devices according to the state of the art, and are to allow shorter time cycles, in particular for the strapping.

This is accomplished by the method and device as defined by the claims.

According to the invention an advantageously pre-formed loop of strapping material (or a looping channel in which the loop is formed respectively) is placed around the recumbent stack being compressed and being positioned in the strapping position by two compression jaws. Positioning of the loop is carried out by a corresponding relative movement between loop and stack (with compression jaws), the movement being substantially horizontally and transverse to the stacking direction. Advantageously the loop, or looping channel, is moved towards the positioned stack. In order to make this corresponding motion practicable with simple means, the compression jaws are equipped for holding the stack from the one side of the conveying surface which is opposite the side from which the loop is positioned and, if necessary, it is equipped for being strapped together with the stack. This kind of strapping necessitates a further, essentially horizontal motion transverse to the stacking direction for separating the compression jaws from the stack after strapping. This movement which is a relative movement between the strapped stack and the compression jaws is advantageously a movement of the compression jaws away from their compressing position on the stack into an inactive position beside the stack.

In the preferred embodiment of the invention a discreet stack is isolated from the continuously growing stack and is further conveyed into a strapping position between the two compression jaws, which protrude into the stack area from one side only. In the strapping position an advantageously pre-positioned loop is placed around the stack and the compression jaws (movement of loop or looping channel, essentially horizontal and transverse to the stacking direction), and the stack, if necessary together with the compression jaws, is strapped by tightening and closing the loop. Then the compression jaws are retracted laterally from the stack area and the strapped stack is conveyed away from the strapping position in a suitable manner, e.g. transverse to the stacking direction.

It is obvious that the described strapping procedure offers a very high flexibility concerning the position and number of straps to be positioned around each stack. A predetermined positioning of the strap on the stack is achieved by proportioning the corresponding motion between stack and loop. For positioning a plurality of straps, an appropriately dimensioned intermediate motion is carried out between successive strappings.

Since the loop of strapping material is able to be made ready prior to, or during, the positioning of the stack in the stacking position, and since after positioning the stack the loop only needs to be shifted a short distance (e.g. half the width of the stack), the time required for the strapping is shorter than it is possible in an device in which the looping channel is not brought into a functional condition to enable the loop to be made ready until after the positioning of the stack. Therefore, according to the invention more time is available for moving the stack into the strapping position and therefore, the capacity can be increased, and/or shorter stacks can be produced.

It shows that the isolation of discreet stacks from the continuously growing stack, the positioning of the endplates at the ends of the isolated stacks, and the taking over of the stacks by the compression jaws are particularly easily achieved if the compression jaws reach into the stack area above the conveying surface from one side only. For this purpose, two support elements are advantageously employed, which can be brought into the stack area from below (raised, active position) and retracted from the stack area (lowered, inactive position) and can be cyclically moved back and forth, parallel to the stacking direction. The design of the support elements is such that they can be simultaneously positioned in the same position of the stack area, i.e. one support element can be slotted into the other one.

BRIEF DESCRIPTION OF THE DRAWINGS

The method according to the invention and an exemplary embodiment of the device according to invention are described in further detail in connection with the following Figures, wherein:

FIG. 4; moment of strapping: FIG. 5; moment of conveying away of the strapped stack: FIG. 6);

DETAILED DESCRIPTION OF THE PREFERRED EMBODIMENT

Figure 1:
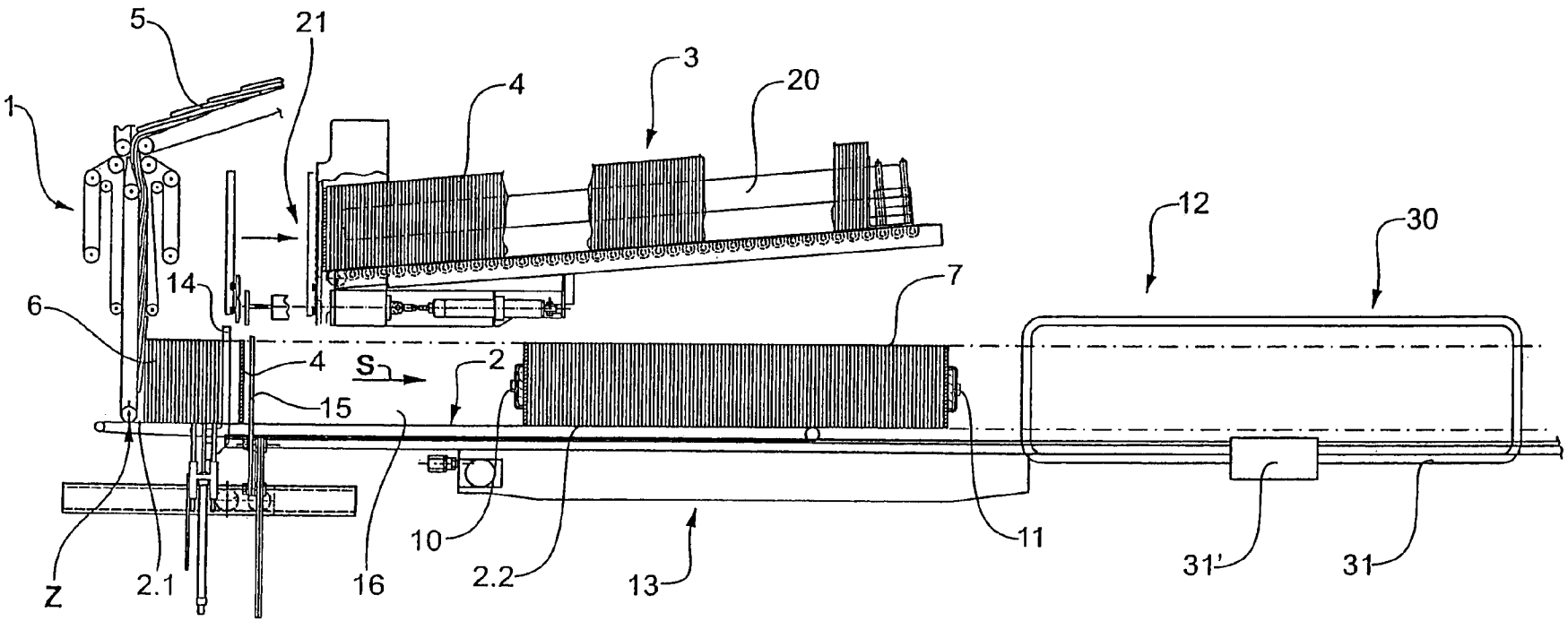
FIG. 1 is a schematic side view of an exemplary embodiment of the device according to the invention.

FIG. 1 is a side view of an exemplary embodiment of the device according to the invention. The device comprises in a generally known manner a supply means 1 and a conveying surface 2, as well as a means 3 for positioning the endplates 4. The supply means 1 comprises e.g. a pair of conveyor belts, driven counter-revolvingly, between which an imbricated stream 5 is conveyed from above on to the conveying surface 2 (supply point Z). The conveying surface 2 is e.g. a conveyor belt moving away from the supply point (stacking direction S) or a plurality of conveyor belts operating in parallel and/or in series. It is advantageous to provide a first conveyor belt 2.1 adjacent the supply point Z, which first conveyor belt is operated continuously with approximately the speed of the stack growth and a second conveyor belt 2.2 which is operated with a cyclically variable speed.

The supplied products line up on the conveying surface 2 to form a continuously growing stack 6, which expands in the stacking direction due to the supply of further products and due to the conveying effect of the conveying surface 2 (speed of stack growth). From the continuously growing stack 6 discreet stacks 7 are isolated and conveyed between an upstream compression jaw 10 and a downstream compression jaw 11 into the strapping position 12, advantageously being compressed during this conveyance and strapped in the strapping position 12. The compression jaws 10 and 11, which move back and forth in parallel to the stacking direction, are e.g. arranged on a compression carriage 13 (see also FIG. 3), which moves back and forth parallel to the stacking direction and which is arranged beside the stack area. In order to isolate the discreet stacks 7 and to transfer them to the compression jaws 10 and 11, a first support element 14 and a second support element 15 are employed, wherein the support elements have an active position above the conveying surface and an inactive position below the conveying surface, and are designed in such a way that the second support element 15 can be inserted into the growing stack 6 at a point where the first support element 14 is already positioned (see also FIG. 2).

The means 3 for positioning the endplates 4 at both ends of the stack to be isolated, or already isolated, is situated above the stack area 16 and advantageously comprises a plate magazine whose front is equipped to position endplates 4 in the stack area and to move, if necessary, an endplate to be positioned in stacking direction S (see also FIGS. 8 to 13).

Situated near the strapping position 12 is a strapping device 30 (see also FIGS. 4 to 6), of which FIG. 1 only shows the looping channel 31 comprising a closing means 31'. Together with the closing means 31' the looping channel 31 forms a substantially closed loop, the format of which is adjusted to the format of the isolated stack 7. The closing means 31' is equipped for guiding the strapping material into the looping channel 31, for gripping the free end of the strapping material loop in the looping channel, for retracting the strapping material to tighten it around the stack, as well as for closing the strapping and for severing the strapping from the further supply of strapping material.

The expression 'stack area' is used in the present description for the room needed by the growing stack 6 and by the isolated stacks 7 until they are strapped. This room extends above the conveying surface 2 from the supply point Z to the strapping position 12, and is as high and as wide as the largest printed products to be processed by the device. The stack area is indicated in the Figs. by dash dot lines and is designated with the numeral 16.

Figure 2:
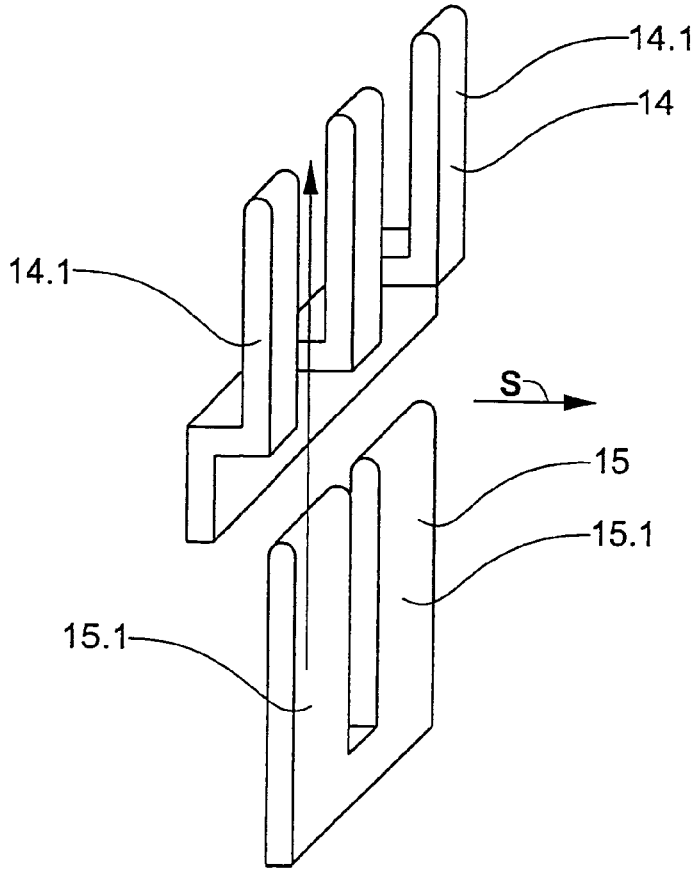
FIG. 2 shows an exemplary embodiment of the two support elements of the device according to the invention.

FIG. 2 shows an exemplary embodiment of the two support elements 14 and 15 of the device according to the invention. The first support element 14 is shown in its active position (at least partially protruding above the conveying surface). In this position it serves to divide the supplied imbricated stream at the supply point and subsequently it serves to support the downstream end of the continuously growing stack, for which purpose it is moved in stacking direction S. For returning to its original position it is lowered beneath the conveying surface. The second support element 15, which serves to isolate a discreet stack, to temporarily support the trailing end of the isolated stack, and to temporarily support the downstream end of the continuously growing stack, is shown in its inactive position (lowered beneath the conveying surface) at the same distance downstream from the supply point as the first support element 14.

For enabling the second support element 15 to be raised from its inactive position into its active position above the conveying surface, it consists e.g. of two support pieces 15.1 distanced from one another. These support pieces are designed for being inserted between correspondingly spaced support pieces 14.1 of the support element 14. The arrow illustrates the insertion of the second support element 15 into the first support element 14.

The function of the two support elements 14 and 15 is described in detail in connection with FIGS. 7 to 13.

Figure 3:
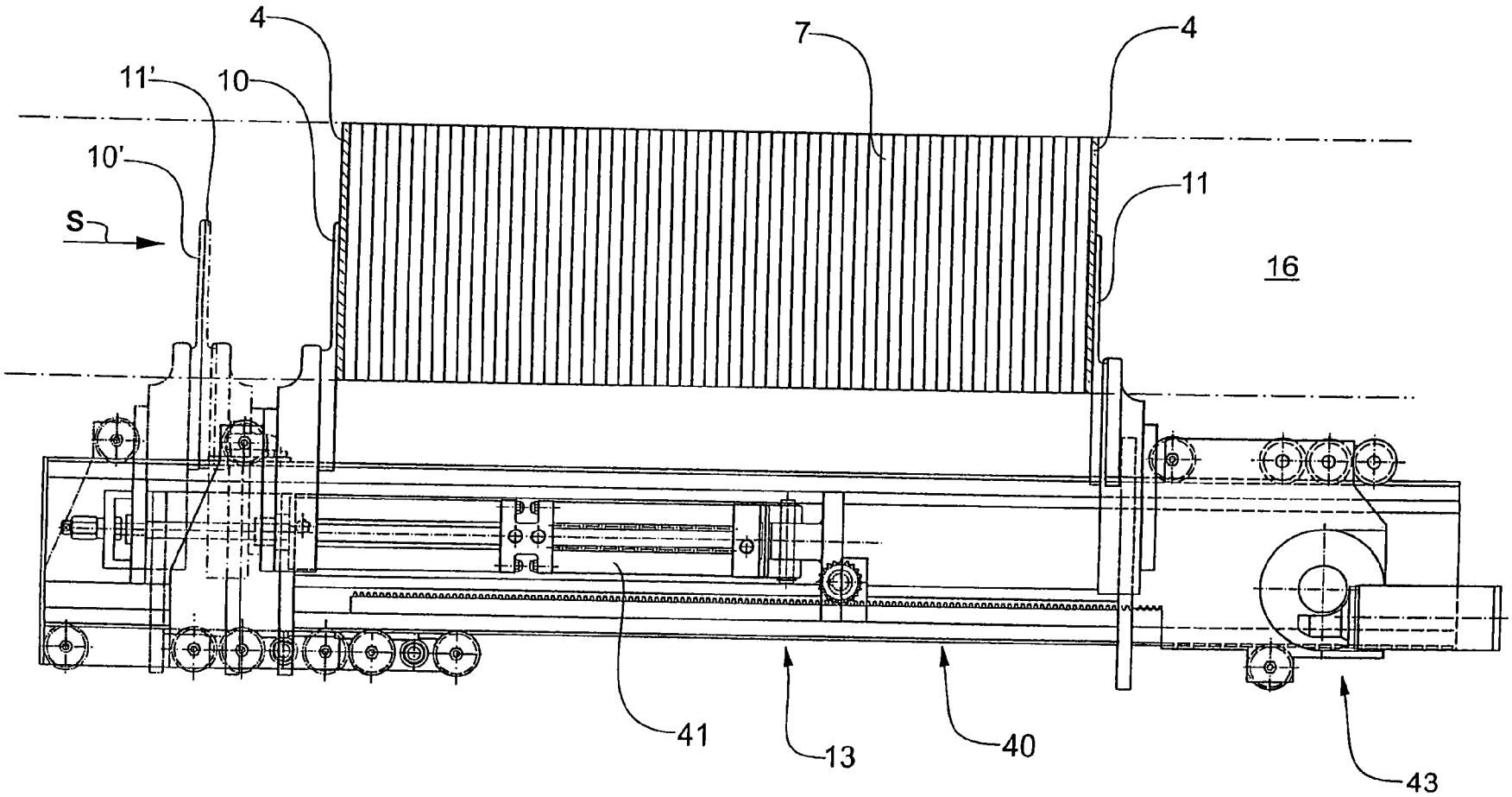
FIG. 3 shows an exemplary embodiment of the two compression jaws of the device according to the invention.

FIG. 3 shows, viewed from above, an exemplary arrangement of the upstream and downstream compression jaws 10 and 11 for the device according to the invention. The compression jaws 10 and 11 are arranged on the compression carriage 13 which is displaceable parallel to the stacking direction S alongside the stack area, wherein the two compression jaws 10 and 11 are in addition movable independent of each other, back and forth on the compression carriage, again parallel to the stacking direction S. The two compression jaws 10 and 11 are shown in a compressing configuration (uninterrupted lines), i.e. inserted in the stack area 16 (active position) and gripping between them an isolated stack 7 with endplates 4, ready to be strapped. Both compression jaws 10 and 11 are also illustrated in their starting position (dash dot lines, 10' and 11').

The upstream compression jaw 10 is moved on the compression carriage from position 10' to position 10. This movement serves to compress a stack 7 positioned between the compression jaws. For effecting this movement guides 40 and e.g. an actuator 41 are provided. The downstream compression jaw 11 is moved from position 11' into position 11, wherein it supports the downstream end of the continuously growing stack. The movement of the compression carriage serves to convey the isolated stack 7 into the strapping position, wherein the stack is compressed immediately before or during the conveyance. The compression carriage 13 and the downstream compression jaw 11 are driven by the actuator 43.

Figure 4:
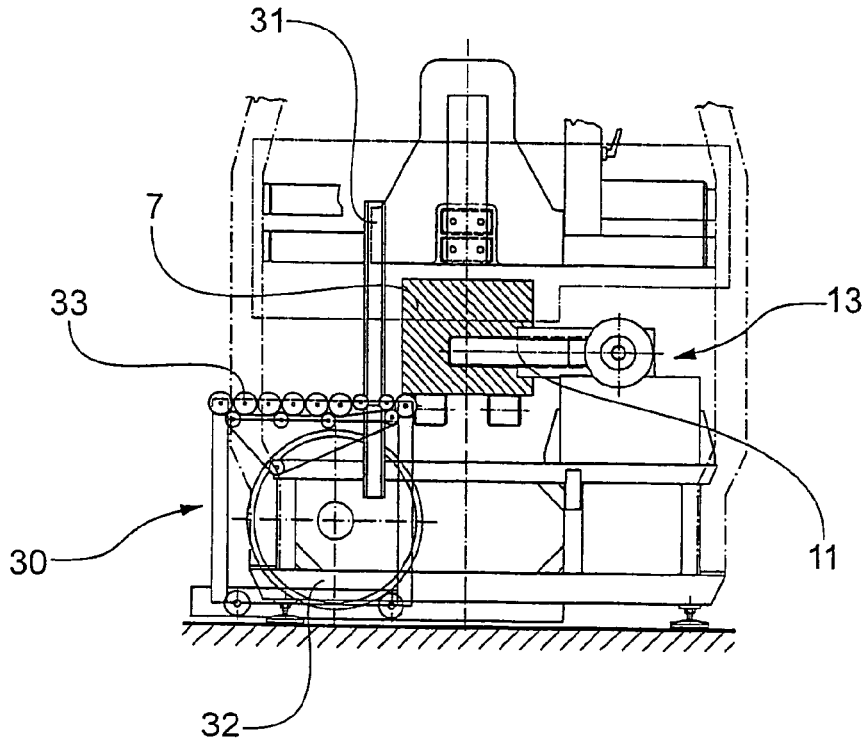
FIGS. 4 to 6 show the strapping position of the device according to the invention viewed in a direction opposing the stacking direction in three phases of the strapping process (moment of conveyance of the stack into the strapping position.
Figure 5:
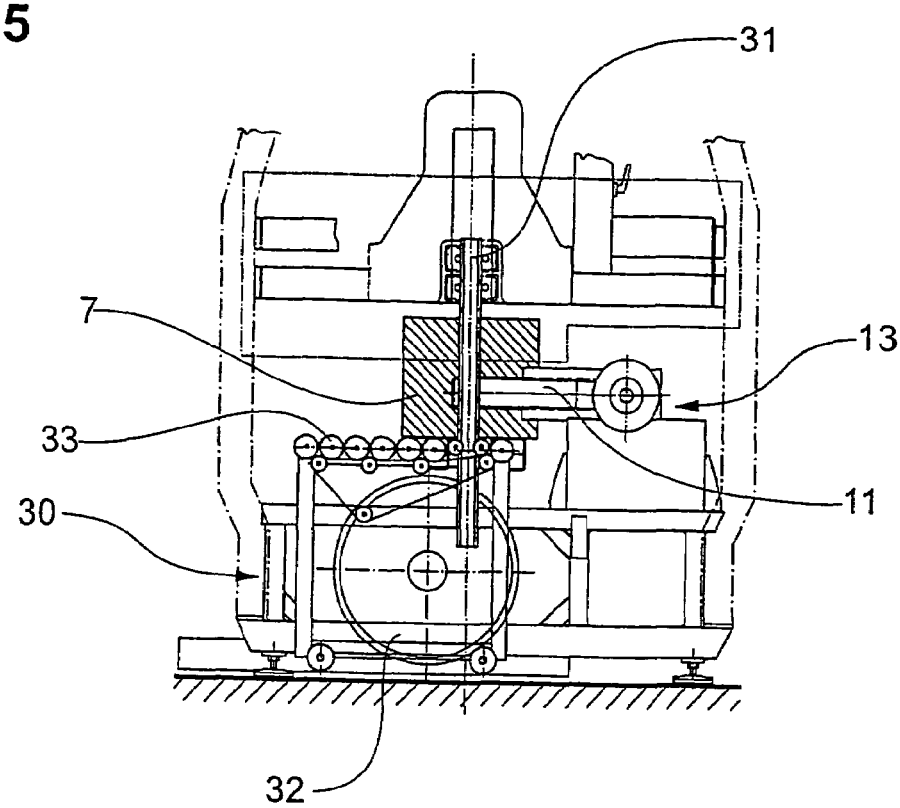
Figure 6:
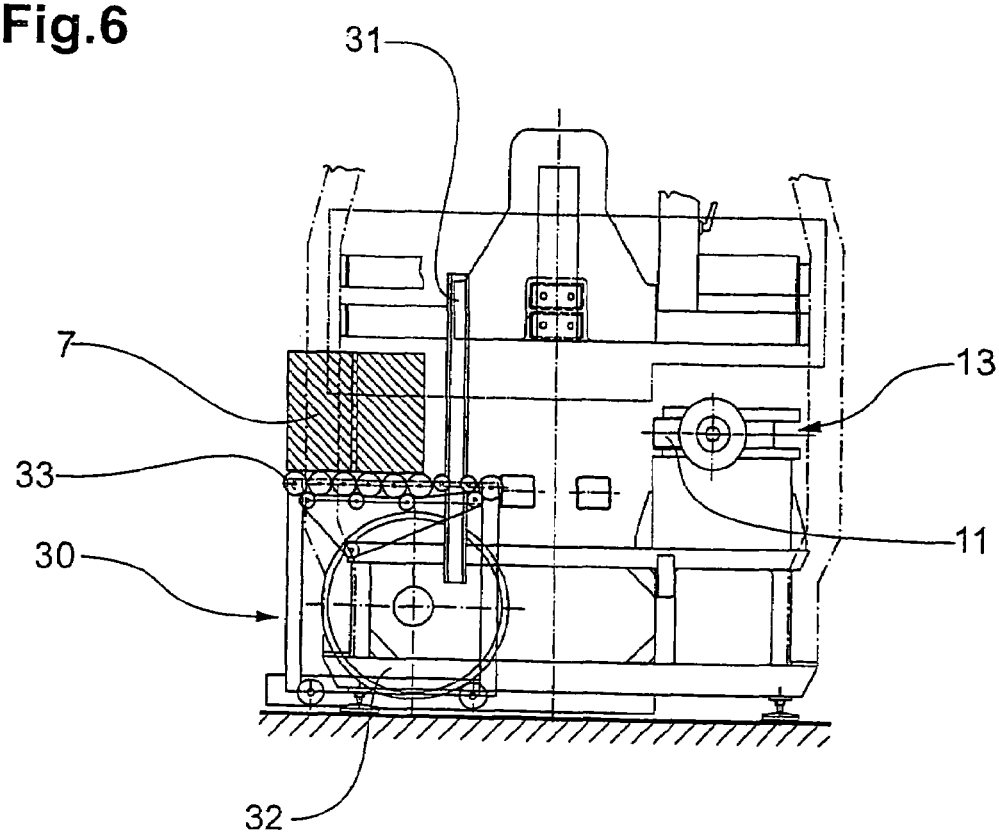

FIGS. 4 to 6 illustrate the strapping of a separated stack 7 in the strapping position (viewing direction opposing the stacking direction).

FIG. 4 illustrates the stack 7, being gripped between the two compression jaws 10 and 11 (downstream compression jaw visible only), and being conveyed into the strapping position or being positioned in the strapping position. The compression jaws are in their active configuration (protruding from one side into the stack area). The strapping device 30 is situated on the other side of the stack area. The main components of the strapping device are the looping channel 31 (closing means not visible), a supply coil 32 of strapping material, and a stack support 33 (e.g. a roller track) being arranged perpendicular to the stacking direction and possibly being powered.

At least the looping channel 31 with the closing means or advantageously the entire strapping device 30 being designed as an independent module, is movable transverse to the stacking direction into at least two different positions. FIG. 4 illustrates the strapping device in its inactive position, in which the looping channel 31 is positioned on the one side of the stack area, which is opposite to the stack area side from which the compression jaws 10 and 11 protrude into the stack area.

FIG. 5 illustrates the strapping device 30 in its active position, in which the looping channel 31 runs lengthwise around the stack 7 positioned in the strapping position, e.g., as illustrated, around the middle of the stack 7. As soon as the strapping device has reached this position the strapping operation is activated, wherein e.g. as illustrated the compression jaws 10 and 11 are strapped together with the stack. In the case of shorter compression jaws, and/or if the strapping was to be placed further left, the compression jaws would not be strapped.

FIG. 6 illustrates the strapped stack 7, separated from the compression jaws by retrieving the compression jaws into their inactive configuration. The stack is now being conveyed away in a direction transverse to the stacking direction. The strapping device 30 has returned to its inactive position.

From FIGS. 4 to 6 it is clear that, instead of the strapping device 30 moving back and forth from an inactive position (FIGS. 4 and 6) into an active position (FIG. 5), the compression jaws 10 and 11 could also be designed for being extended into further positions while the strapping device 30, or rather the looping channel 31, remains stationary. To separate the strapped stack 7 from the compression jaws 10 and 11, as illustrated, the compression jaws are advantageously retracted into their inactive configuration, wherein the weight of the stack is usually sufficient to keep the stack from being moved together with the stack. Stack separation can also be implemented by shifting the stack 7 transverse to the stacking direction against the strapping device 30. In this case action of the stack support 33 may not suffice for effecting the separation, so that further suitable means to shift the stack are to be provided.

Figure 7:
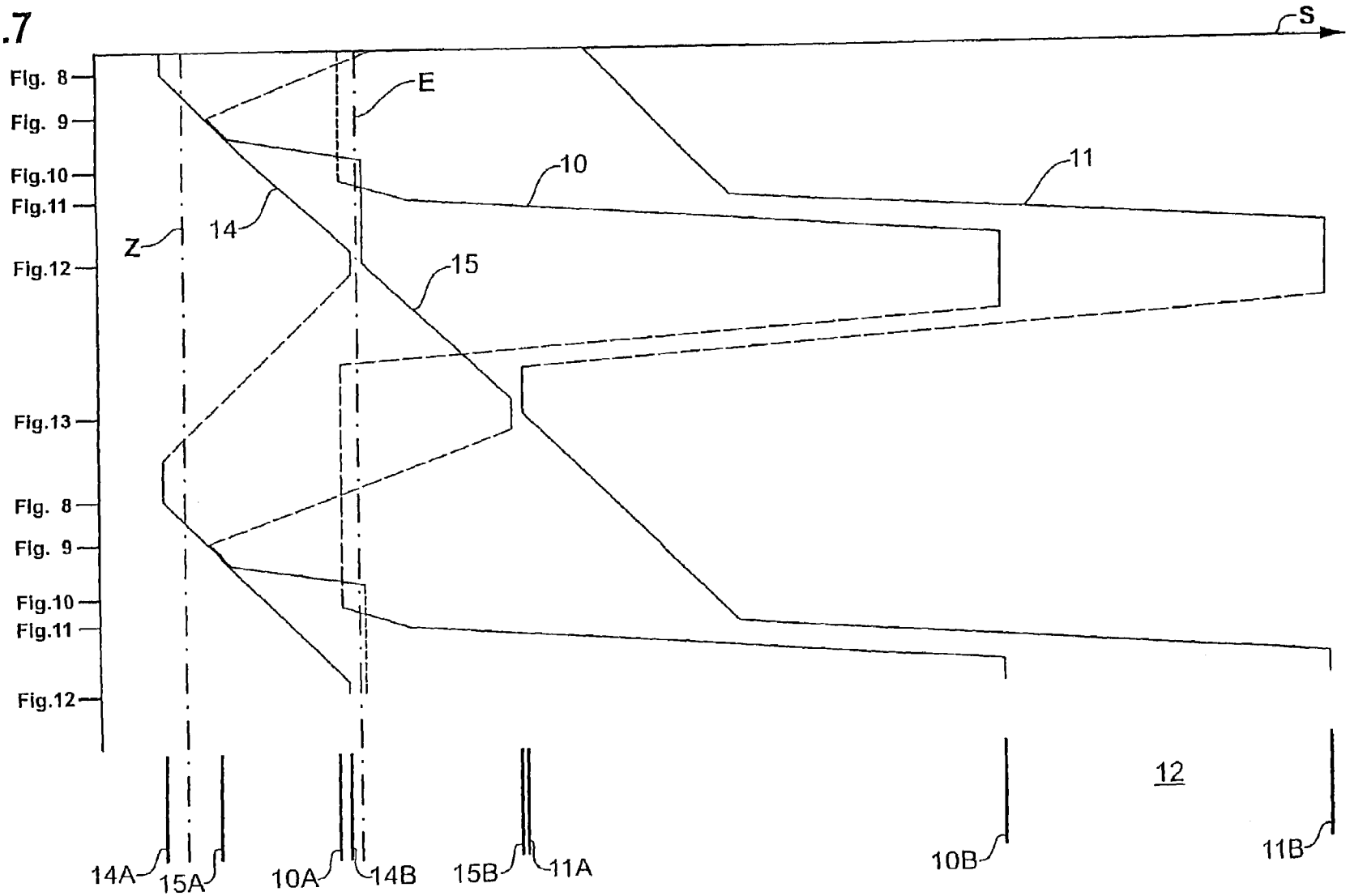
FIG. 7 shows an example of a time/path diagram for the two support elements and the two compression jaws of the device according to the invention.
Figure 8:
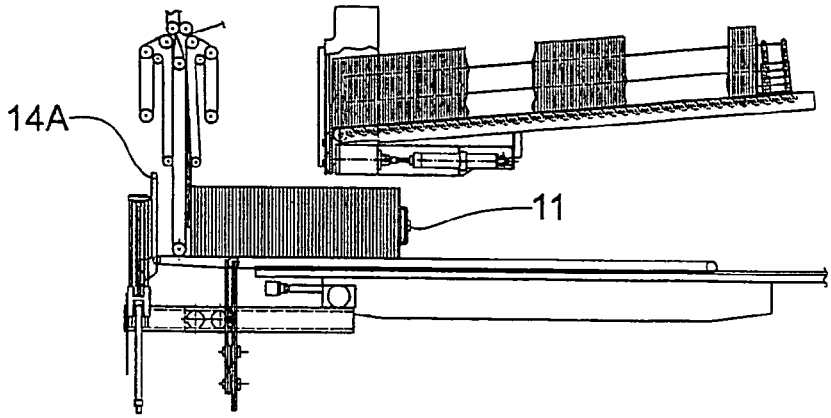
FIGS. 8 to 13 show successive phases of the isolation of a discreet stack from the continuously growing stack.
Figure 9:
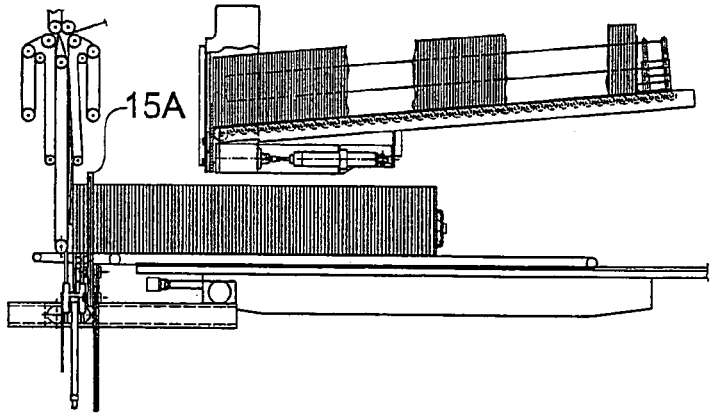
Figure 10:
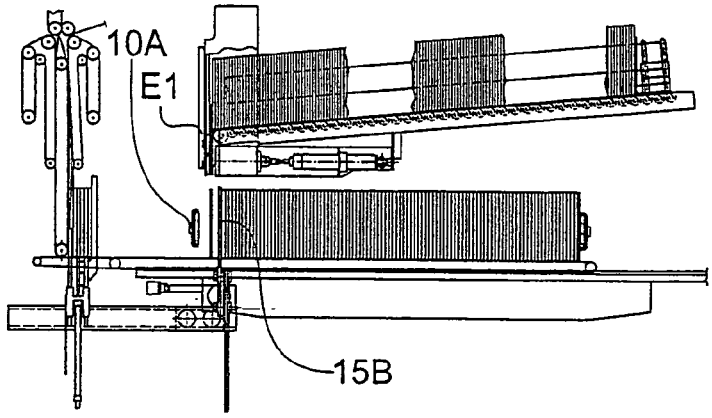

FIGS. 7 to 13 illustrate schematically the function of those elements of the device according to the invention, which serve to isolate a stack 7 from the continuously growing stack 6 and to temporarily support the free stack ends. These elements are in particular the two support elements 14 and 15, and the two compression jaws 10 and 11. FIG. 7 is a time/path-diagram, wherein the time axis is directed from top to bottom and the stacking direction S from left to right. FIGS. 8 to 13 show in a side view (essentially as in FIG. 1), successive phases of the stack formation. FIG. 7 and FIGS. 8 to 13 show about the same process but differ in some details which illustrate the fact that there are various embodiments of the method according to the invention. All the same, the moments indicated along the time axis in FIG. 7 correspond in the main with the moments shown in FIGS. 8 to 13. In FIG. 7, drawn-out lines signify elements in their active configuration, intermittent lines signify elements in their inactive configuration. In FIGS. 8 to 13 only the most important reference numerals are provided. Further reference numerals mentioned in the text can be seen in FIG. 1.

The two support elements 14 and 15 and the two compression jaws 10 and 11 alternately conduct (in their active configuration) an active forward stroke in stacking direction S from an upstream starting position (14A, 15A, 10A, 11A) to a downstream end position (14B, 15B, 10B, 11B) and (in their inactive or possibly active configuration) a passive return stroke in the reverse direction.

The first support element 14 serves to divide the growing stack 6 and to temporarily support its downstream end. Its starting position 14A lies, upstream of the supply point Z. The speed of its active forward stroke is, in the main, the same as the speed of the stack growth.

The second support element 15 serves together with the first support element 14 to divide the growing stack 6 and to temporarily support the upstream end of an isolated stack 7 and to transfer this stack end to the upstream compression jaw 10. It further serves to temporarily support the downstream end of the growing stack 6 and to transfer this stack end to the downstream compression jaw 11. Its starting position 15A lies downstream of the supply point Z and upstream of the end position 14B of the first support element 14. The end position 15B of the second support element 15 lies downstream of the end position 14B of the first support element 14 and downstream of the starting position 10A of the upstream compression jaw 10. The forward stroke of the second support element 15 is interrupted by a passive phase, in which the element is stationary (FIG. 7 with only one position E of the endplate supply) or moves upstream (FIGS. 8 to 13 with two positions E1 and E2 of the endplate supply). Before the passive phase the speed of the second support element 15 is greater than the speed of the stack growth, after the passive phase it is about the same as the speed of stack growth.

The upstream compression jaw 10 serves the compression of the complete stack and its conveyance into the strapping position. Its starting point 10A lies upstream of the position that the second support element 15 reaches in the first part of its forward stroke, its end position 10B lies on the entry side of the strapping position 12. Its forward speed is considerably greater than the speed of the stack growth.

The downstream compression jaw 11 serves the temporary support of the downstream end of the growing stack and the conveyance of the isolated stack into the strapping position 12. Its starting position 11A lies downstream of the starting position 10A of the upstream compression jaw 10 and downstream of the end position 15B of the second support element 15. Its speed is in the first phase of its forward stroke about the same as the speed of the stack growth, then considerably greater.

The functional cycles of the two support elements 14 and 15 and of the two compression jaws 10 and 11 are interengaging and proceed as follows:

While the downstream compression jaw 11 supports the downstream end of the growing stack 6, the first support element 14 is moved from its starting position 14A (FIG. 8) through the supply point Z into the continuously growing stack and past the starting position 15A of the second support element 15 to its end position 14B. At the starting position 15A of the second support element 15 the latter is inserted from below into the first support element 14 (FIG. 9) and is then accelerated relative to the first support element such that between the two support elements a gap is formed in the growing stack 6. Thereby the second support element 15 supports the upstream end of an isolated stack 7 and the first support element 14 supports the downstream end of the continuously growing stack 6.

Figure 11:
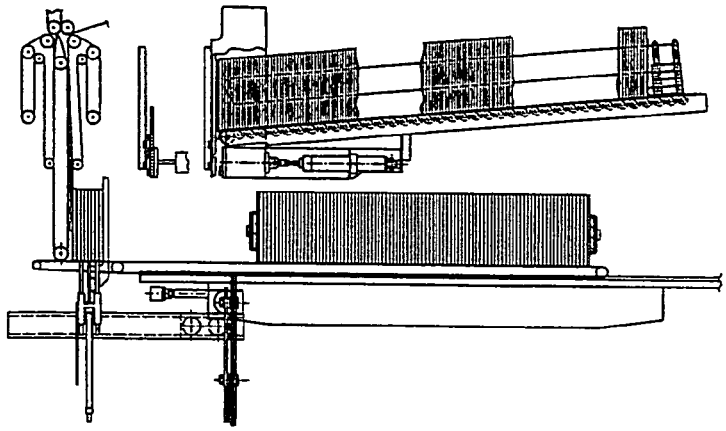

While the first support element 14 is moved at the speed of the stack growth, the second support element 15 pushes the upstream end of the isolated stack 7 just downstream of the starting position 10A of the upstream compression jaw 10, which is then inserted into the stack area. Between the upstream compression jaw 10 and the second support element 15 (endplate positioning E or E1) the rear endplate 4 is then positioned (FIG. 10), whereupon the second support element 15 is lowered beneath the conveying surface. The upstream compression jaw 10, which has taken over the upstream end of the isolated stack, now starts its forward stroke, which comprises a compression stroke (motion of the upstream compression jaw on the compression carriage) and a conveying stroke (travel of the compression carriage) (FIG. 11, after the compression stroke). The compressed stack is now positioned between the two compression jaws 10 and 11 and can be conveyed into the strapping position (forward travel of the compression carriage).

Figure 12:
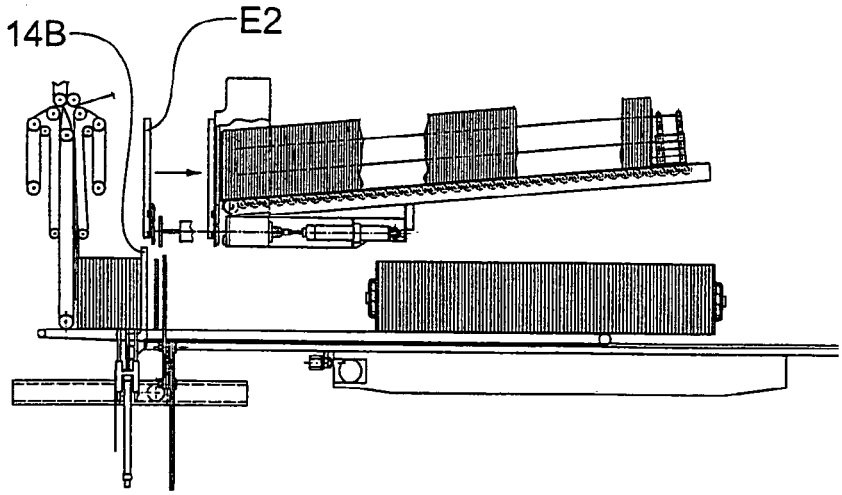
Figure 13:
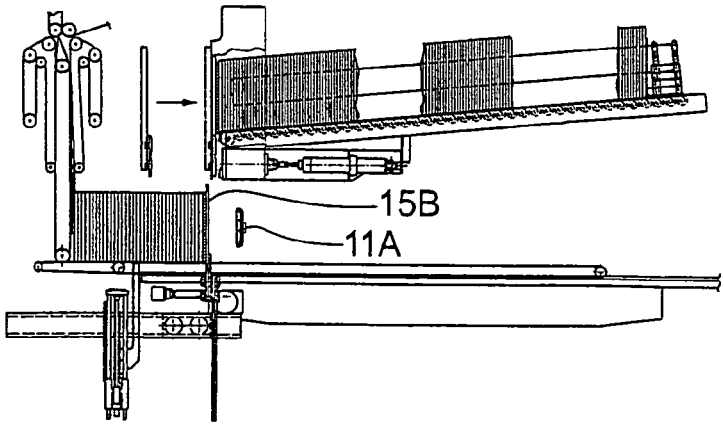

The lowered second support element 15 waits for the first support element 14 (embodiment according to FIG. 7) or moves towards the first support element 14 (embodiment according to FIGS. 8 to 13) until the two support elements are close enough to each other for enabling the front endplate 4 to be positioned (endplate positioning E or E2) there between (FIG. 12). The first support element 14 has thereby reached its end position 14B and is lowered beneath the conveying surface. The second support element 15 begins the second part of its forward stroke, wherein it is brought almost to the starting position 11A of the downstream compression jaw 11 (FIG. 13). The second support element 15 is lowered underneath the conveying surface and begins its backward stroke, while the front compression jaw 11, supporting the downstream end of the growing stack, begins the first part of its forward stroke at the speed of the stack growth (motion of the downstream compression jaw 11 on the compression carriage).

Throughout the entire operation, the first conveyer belt 2.1 is driven at a speed roughly equivalent to that of the stack growth. During the first part of the forward stroke of the downstream compression jaw 11, the second conveyer belt 2.2 is driven at the same speed as the first conveyer belt, during the second part of the forward stroke of the downstream compression jaw 11 (forward travel of the compression carriage), at roughly the same speed as the compression carriage 13.

The advantages of method and device according to the invention lie in the simplicity of the means, which serve for isolating the discreet stacks from the continuously growing stack, for positioning the endplates, for conveying the discreet stack into the strapping position and for strapping the stacks; as well as in the simplicity with which these means are controlled. Further advantages lie in the form and control of the compression jaws and in the relative motion between the stack to be strapped and the strapping device. These two characteristics permit compressing the stack and placing a loop of strapping material in the looping channel, during conveyance of the stack into the strapping position, and therefore, they allow a very short cycle time. Furthermore, the strapping of stack and compression jaws, combined with the aforementioned relative motion, permits an extremely simple switch from a single to a multiple, e.g. double, strapping.

The invention claimed is:

1. A method for producing and strapping recumbent stacks of printed products, comprising the steps of:

supplying the printed products at a supply point (Z) from above on to a conveying surface (2);

conveying the printed products, which are standing on one edge, on the conveying surface as a continuously growing stack in a stacking direction (S) away from the supply point (Z);

isolating discreet stacks (7) from the continuously growing stack;

positioning endplates (4) at a downstream and an upstream end of each discreet stack; and conveying each isolated discreet stack while holding said each isolated discreet stack between a downstream and an upstream compression jaw (11 and 10), in the stacking direction (S) into a strapping position (12);

compressing each isolated discreet stack with said upstream and downstream compression jaws, and while compressed, strapping same with a strapping material, wherein the step of conveying the discreet stack (7) into the strapping position (12) includes moving the two compression jaws (10,11) into a stack area;

from a first side of the conveying surface (2) in an essentially horizontal motion transverse to the stacking direction (S), and wherein the step of strapping includes preparing a loop of strapping material on a second side of the conveying surface (2) opposite its first side and positioning the loop around the stack (7) through an essentially horizontal relative motion transverse to the stacking direction, between the loop and the stack (7) held by the compression jaws (10,11).

2. The method according to claim 1, further comprising tightening the loop as the stack (7) is strapped together with the compression jaws (10, 11) and separating the strapped stack (7) from the compression jaws (10, 11) by an essentially horizontal relative motion transverse to the stacking direction, between the compression jaws (10, 11) and the strapped stack (7).

3. The method according to claim 1, wherein the stack (7), held between the compression jaws (10, 11), remains stationary in the strapping position (12) and the loop is moved towards the stack (7).

4. The method according to claim 2, wherein, the step of separating the stack (7) from the compression jaws (10, 11) comprises retracting the compression jaws from the stack area (16).

5. The method according to claim 1, wherein, between successive strapping processes, a further essentially horizontal relative motion transverse to the stacking direction, is performed between the loop and the stack (7) held by the compression jaws (10, 11).

6. The method according to claim 1, wherein, the step of isolating the discreet stack (7) from the continuously growing stack (6), comprises the further steps of:

moving a first support element (14) in stacking direction (S) from a starting position (14A) upstream of the supply point (Z) through the supply point (Z);

inserting a second support element (15) from below the conveying surface (2) into the first support element (14) in a position downstream of the supply point (Z) and, in relation to the first support element (14), the second support element (15) is accelerated in stacking direction (S).

7. The method according to claim 6, further comprising transferring the upstream end of an isolated stack (7) to the upstream compression jaw (10), wherein the second support element (15) is moved in stacking direction (S) just downstream of a starting position (10A) of the upstream compression jaw (10), the upstream compression jaw (10) is moved into the stack area (16) and is then moved in stacking direction (S), and the second support element (15) is lowered below the conveying surface (2).

8. The method according to claim 7, wherein a rear end plate of the endplates is positioned between the upstream compression jaw (10) and the second support element (15) before the second support element (15) is lowered.

9. The method according to claim 8, wherein the endplates (4) are inserted into the stack area from above for being positioned at the discreet stack ends.

10. The method according to claim 7, further comprising transferring a downstream end of the continuously growing stack (6) to the downstream compression jaw (11), said transferring to the downstream compression jaw comprising the further steps of:

the second support element (15) waiting downstream of the starting position (10A) of the upstream compression jaw (10), moving the upstream compression jaw (10) into the stack area (16) and is then in stacking direction (S), and lowering the second support element (15) below the conveying surface (2).

11. The method according to claim 10, further comprising lowering the first support element, wherein a front endplate (4) is positioned between the first support element (14) and the second support element (15) before the first support element (14) is lowered.

12. A device for producing and strapping recumbent stacks of printed products, said device comprising a supply point (Z) where the printed products are supplied from above on to a conveying surface (2), wherein the conveying surface extends from the supply point (Z) in stacking direction (S) to a strapping position (12) and a stack area (16) is reserved above the conveying surface, and said device further comprising means for isolating discreet stacks (7) from a stack (6) that is continuously growing along the conveying surface (2), means for positioning endplates (4) at a downstream and an upstream end of the isolated stack (7), an upstream and a downstream compression jaw (10, 11) for holding the isolated stack and for conveying the held stack into the strapping position (12), and a strapping device (30) for strapping the isolated stack (7) in the strapping position, wherein the compression jaws (10, 11) are arranged to be moveable from a first side of the stack area (16) into and out of the stack area (16), the strapping device (30) comprises a looping channel (31) with a closing means (31'), the strapping device being arranged in the area of the strapping position, at least when inactive, on a second side of the stack area (16) opposite the first side, and the compression jaws (10, 11) and the looping channel (31) with the closing means (31') are moveable relative to each other, substantially horizontally and transverse to the stacking direction (S).

13. The device according to claim 12, wherein the compression jaws (10, 11) when positioned in the stack area (16) reach from the first side of the stack area (16) beyond the middle of the stack area (16).

14. The device according to claim 12, wherein the conveying surface (2) comprises a conveyor belt (2.1) that is adapted to be driven at a constant speed, away from the supply point (Z), as well as a second conveyor belt (2.2) that is adapted to be driven at a variable speed and being arranged adjacent the first conveyor belt (2.1).

15. The device according to claim 12, further comprising a compression carriage (13) that is adapted to move back and forth in parallel to the stacking direction (S), said compression jaws (10, 11) being arranged on the compression carriage (13), said compression jaws being moveable independently of each other back and forth parallel to the stacking direction (S).

16. The device according to claim 12, wherein the means for isolating a discreet stack (7) comprises a first support element (14) and a second support element (15), both support elements (14, 15) being designed to be moveable back and forth parallel to the stacking direction (S) and to be lowered and raised below and above the conveying surface (2) and to be positioned simultaneously in the same spot of the stack area (16).

17. The device according to claim 12, wherein the means for positioning the endplates (4) comprises an endplate storage unit (20) situated above the stack area (16), a head (21) of said endplate storage unit being is equipped for positioning endplates (4) in the stack area (16).

18. The device according to claim 17, wherein, in addition to being equipped for positioning endplates, the head (21) is further equipped for moving the endplates parallel to the stacking direction (S).

* * * * *